US006144274A

United States Patent [19]

Bischke et al.

[11] Patent Number: 6,144,274

[45] Date of Patent: Nov. 7, 2000

[54] MAGNETIC RESONANCE IMAGING CRYOCOOLER POSITIONING MECHANISM

[75] Inventors: Lawrence Vincent Bischke, Florence; Gerhard Siegfried Kobus, Effingham, both of S.C.; Paul Chester Senski, Waukesha, Wis.

[73] Assignee: General Electric Company, Milwaukee, Wis.

[21] Appl. No.: 09/442,182

[22] Filed: Nov. 16, 1999

[51] Int. Cl.[7] ..... H01F 6/00; F25B 19/00

[52] U.S. Cl. ..... 335/216; 62/51.1; 324/318

[58] Field of Search ..... 335/216, 300; 62/51.1, 383; 324/318, 319, 320

[56] References Cited

U.S. PATENT DOCUMENTS 5,613,367 3/1997 Chen ..... 62/47.1

*Primary Examiner*—Lincoln Donovan
*Assistant Examiner*—Ray Barrera
*Attorney, Agent, or Firm*—Irving M. Freedman; Christian G. Cabou; Phyllis Y. Price

[57] ABSTRACT

An insertion and positioning mechanism to assist in inserting the cryocooler into the sealed cavity of a recondensing superconducting magnet during superconducting operation utilizing guide assembly and slider assembly combinations to resist forces of cryocooler interaction with the magnetic field of the superconducting magnet to avoid misalignment, and to ensure good thermal contact at the cryocooler thermal interfaces.

17 Claims, 2 Drawing Sheets

62
19
15
61
62
57
57
56
30
9
58
2
12
13
58
21
82
82
10
4
9
22
60
8
35
60
14
34
47
50
49
40
32
36
42
44
34
38

MAGNETIC RESONANCE IMAGING CRYOCOOLER POSITIONING MECHANISM

BACKGROUND OF INVENTION

This invention relates to superconducting magnet assemblies suitable for magnetic resonance imaging (hereinafter called "MRI"), and more particularly to a cryocooler positioning mechanism for such a superconducting magnet.

As is well known, a superconducting magnet can be made superconducting by placing it in an extremely cold environment, such as by enclosing it in a cryostat or pressure vessel containing liquid helium or other liquid cryogen. The extreme cold ensures that the magnet coils are maintained in superconducting operation, such that when a power source is initially connected to the magnet coils for a short period of time to introduce a current flow through the coils, the current will continue to flow through the coils even after power is removed due to the absence of electrical resistance in the coils, thereby maintaining a strong magnetic field. Superconducting magnet assemblies find wide application in the field of MRI.

Considerable research and development efforts have been directed at minimizing the need to replenish the boiling cryogen such as helium. This has led to the use of cryogen gas recondensing systems utilizing a mechanical refrigerator or cryocooler to cool the cryogen gas and recondense it back to liquid cryogen for reuse.

However, from time to time it becomes necessary to remove the cryocooler for replacement and/or servicing. It is desirable to accomplish this without discontinuing superconducting operation of the magnet because of the time and expense resulting from relatively long "down-time" and subsequent ramping up period of bringing the magnet back to superconducting operation.

However, it has proven difficult to insert a replacement cryocooler into the cryocooler sealed cavity of the operating superconducting magnet because of the interaction of the strong magnetic field present and the magnetic materials in the cryocooler. The attractive magnetic forces tend to pull the cryocooler cold head out of alignment, which during insertion leads to conditions of misalignment and poor thermal contact with the thermal interfaces for the superconducting magnet thermal radiation shield and recondenser. Also, the weight of the cryocooler (typically 45 to 47 pounds) makes proper positioning of the cryocooler difficult particularly in the presence of the strong magnetic forces. The magnetic forces when added to the weight of the cryocooler can also raise a possible safety problem for the field engineer. Moreover, the ride-through period during which superconducting operation of the magnet continues without cryogen recondensing is limited, and delays in securing proper alignment and proper thermal contact can lead to unplanned and undesired quenching of superconducting operation.

Thus, there is a particular need for cryocooler system which minimizes the difficulties in properly positioning the cryocooler in the sealed cavity, and obtaining during the short ride-through period good thermal contact between the cryocooler, magnet, and recondenser.

BRIEF SUMMARY OF INVENTION

A cryocooler positioning and securing system for use in selectively inserting the cryocooler into the sealed cavity of a superconducting magnet includes a guide assembly and a slider assembly. The guide assembly includes a hollow tube with a mounting bracket for securing it to the magnet outside and adjacent the sealed cavity. The slider assembly includes a slider rod dimensioned to pass through and beyond the hollow tube of the guide assembly and brackets for mounting the rod to the cryocooler warm end flange. The slider rod is substantially longer than the hollow tube such that the rod can be guided and inserted into the hollow tube while the cryocooler is outside the sealed cavity and positioned in a low field or low strength area of the magnetic field generated by the operating superconducting magnet. The combination of the rod and guide assemblies avoids misalignments and potentially poor thermal contact between the cryocooler and magnet that might otherwise result from the magnetic field forces acting on the cryocooler. This facilitates rapid removal and replacement of the cryocooler while the superconducting magnet is operating at field.

A threaded fastener passing through the guide tube and contacting the slider rod secures the rod and cryocooler in position after good thermal contact is obtained between the cryocooler and sealed cavity thermal interfaces to maintain the good thermal contact.

DETAILED DESCRIPTION OF THE PREFERRED EMBODIMENT

Figure 1:
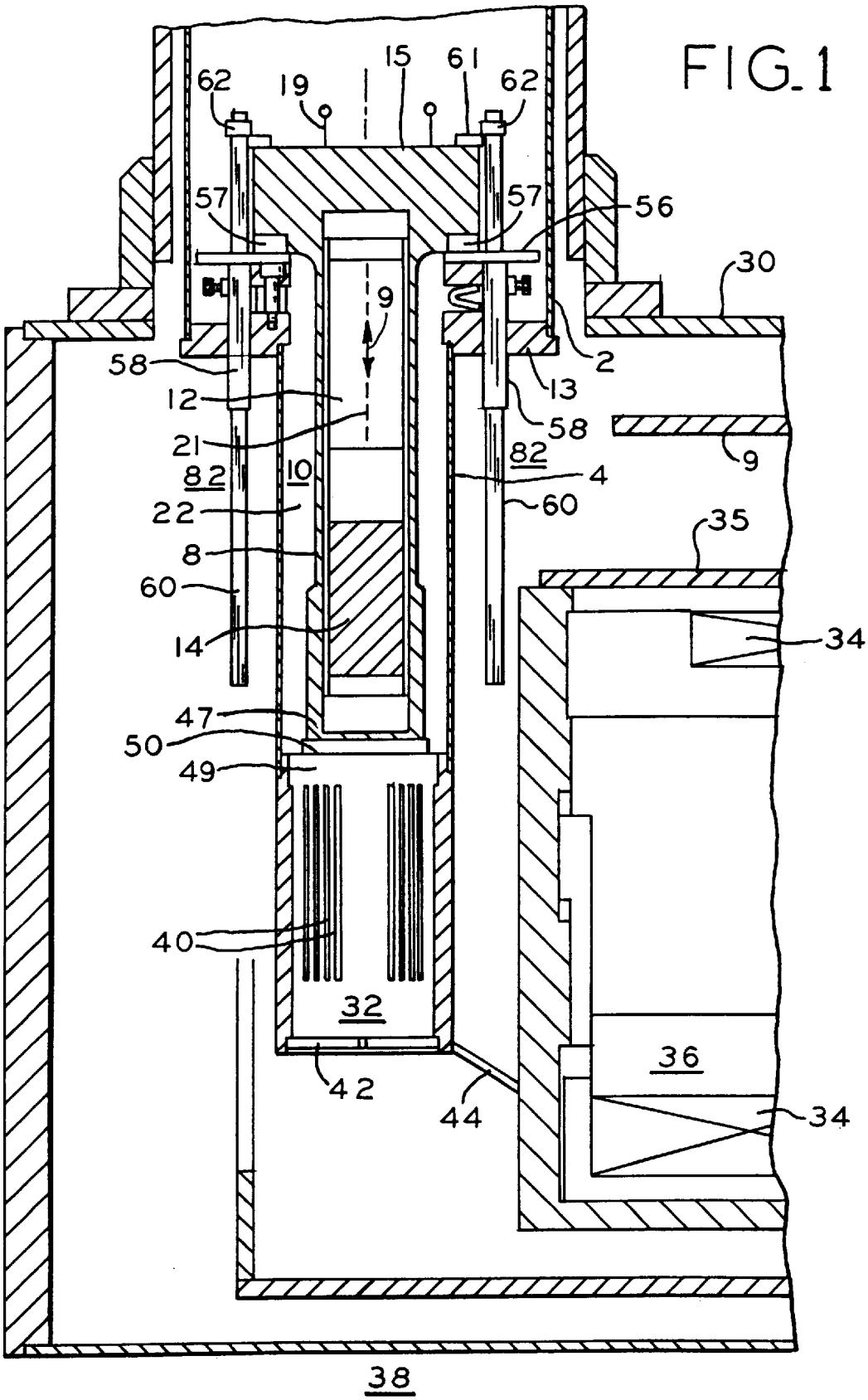
FIG. 1 is a cut away view of an MRI superconducting magnet showing one embodiment of the present invention.

Referring first to FIG. 1, two-stage cryocooler 10 includes housing 8 forming an internal cylindrical bore 12 in which displacer 14 is driven by an AC drive motor (not shown) through a mechanical drive as indicated by arrow 9 along axis 21 of the cryocooler and also of sealed cavity 22 which is described below in the manner well known in the art.

Cryocooler 10 is inserted into sealed cavity 22 formed by walls 4 and flange 13 within MRI superconducting magnet 30. In operation, cryocooler 10 reduces the temperature of cryogen recondensing apparatus 32 to which it is thermally connected to superconducting temperatures. The thermal connection is made through separable thermal joints or thermal interface 50 which includes copper thermal member 47 on cryocooler 10 and copper thermal member 49 within MRI superconducting magnet 30 and forming the bottom surface of cavity 32. This enables the removal of cryocooler 10 without breaking the vacuum within superconducting magnet 30 or discontinuing superconducting operation of the magnet. Recondenser 32 provides recondensing and recycling of the boiled cryogen, typically helium gas resulting from the boiling of liquid helium from helium reservoir 36 within pressurized vessel 35 to cool main magnet coils 34 to superconducting temperatures and provide a strong magnetic field in the imaging volume in bore 38.

Helium gas is passed between recondensing surfaces 40 to be recondensed and returned via return 44 as liquid helium to the liquid helium reservoir indicated generally as 36 within pressurized vessel 35 of MRI superconducting magnet 30. Recondensing surfaces 40 are formed by slots in thermal member 54 through which the helium gas flows to be recondensed. The result is a zero boiloff closed loop helium boiling and recondensing system without the need to replenish boiled helium by periodic additions of external liquid helium.

Thermal radiation shield 9 is thermally connected to the first stage of cryocooler 10 through braided copper wires (not shown) connected to the thermal interface between sealed cavity 22 and the cryocooler.

From time to time it becomes necessary to replace cryocooler 10 due to malfunctions of the cryocooler or the need to perform routine maintenance. It is highly desirable to rapidly remove cryocooler 10 from sealed cavity 22 to provide a replacement cryocooler without disturbing the superconducting operation of magnet 30 in order to avoid MRI downtime, and the time and expense which would otherwise result if the magnet were to quench or cease superconducting operation and have to be subsequently ramped up and placed back into superconducting operation.

The removal and replacement of cryocooler 10 thus must be accomplished in the relatively short time period available before liquid helium 34 boils off causing a discontinuance of superconducting operation of coils 34, the so-called ride-through period. Moreover, the magnetic field generated by superconducting coils 34 exerts strong magnetic forces on the magnetic material, such as stainless steel, of cryocooler 10. The magnetic forces tend to pull the cryocooler out of alignment, or centered, within sealed cavity 22 which in turn prevents good thermal contact between the surfaces of the thermal interfaces such as the copper thermal members 47 and 49 of thermal joint 50. The lack of good thermal contact in thermal joint 50 can interfere with and/or prevent the necessary recondensing action provided by recondenser 32.

Figure 2:
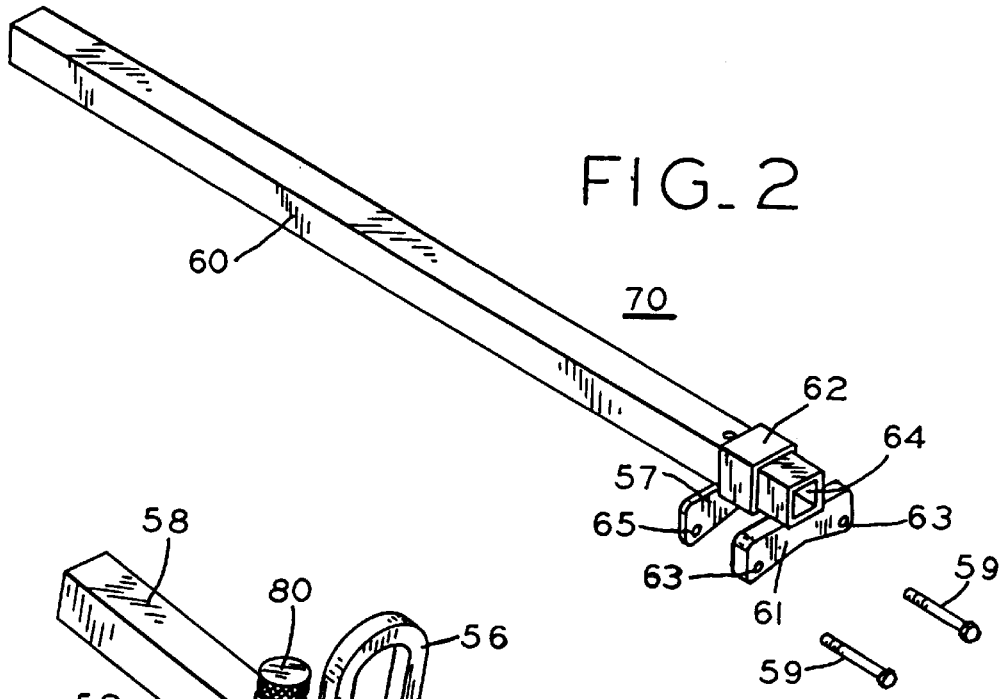
FIG. 2 is an isometric view showing details of the guide assembly of FIG. 1.
Figure 3:
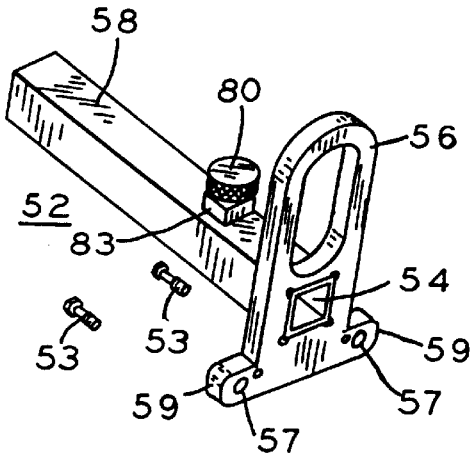
FIG. 3 is an isometric view showing details of the slider assembly of FIG. 1.
Figure 4:
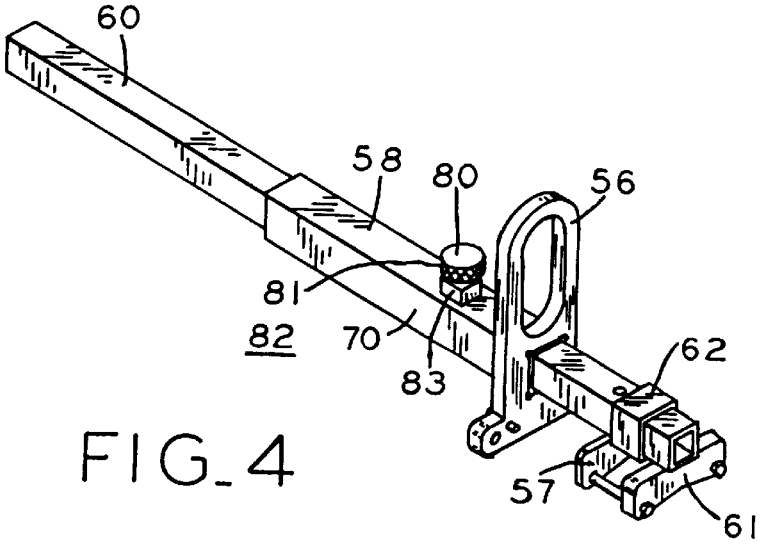
FIG. 4 is an isometric view showing details of the cooperating guide and slider assemblies of FIGS. 1–3.

One or more combinations 82 of cooperating guide assembly 52 and slider or rod assembly 70 are provided to position and axially guide cryocooler 10 into sealed cavity 22. The details of guide assembly 52 and slider assembly 60 are shown in FIGS. 2–4. Referring first to FIGS. 1 and 3, guide assembly 52 includes a central axial aperture 54 through mounting bracket 56 and guide tube 58. Aperture 54 is shown as rectangular in cross-section which is desirable for positive positioning if only a single set of cooperating guide 52 and slider 60 assemblies are utilized. Aperture 52 could be of other cross-sections such as circular, particularly if a plurality of cooperating guide assembly 52 and slider assembly combinations 82 are utilized around the periphery of cryocooler 10.

As best shown in FIG. 2, slider assembly 70 includes a slider rod 60 and mounting brackets 57 and 61. Rod 70 is dimensioned to fit closely but slidably within aperture 54 of guide assembly 52. It is to be noted that guide tube 58 is considerably shorter than slider rod 60, and in one application the guide tube was 9.5 inches long while slider rod 60 was 24 inches long. To reduce the overall weight of cryocooler assembly 10 rod 60 is in tubular form including hollow center or aperture 64. Guide tube 58 is 1.25×1.25 inches with a wall thickness of 0.11 inches and aperture 54 has an internal dimension of 1.14×1.14 inches. Rod 60 is 1.00×1.00 inches providing a nominal total clearance of 0.14 inches between opposite sides of aperture 54 of guide assembly 52 to facilitate insertion and withdrawal of cryocooler 10 to which the rod is secured.

As best shown in FIGS. 1 and 3, guide assembly 52 is positioned adjacent but outside sealed cavity 22 by attachment to flange 13 of superconducting magnet 30. Bolts 53 pass through apertures 55 in flange 13 to threaded openings 57 in ears 59 of mounting bracket 56. As best shown in FIGS. 1 and 2, slider assembly 70 is secured to warm end flange 15 of cryocooler 10 through mounting bracket 62 which includes a pair of plates 57 and 61 which are positioned on opposite sides of flange 15 which surrounds and closes the warm upper end of sealed cavity 22. Sealed cavity flange 13, and abutting cryocooler warm end flange 15 on cryocooler 10, cooperate to complete the sealing of sealed cavity 22 when the cryocooler is secured within the sealed cavity to superconducting magnet 30. Bolts 59 pass through apertures 63 in plate 61 to threaded apertures 65 in plate 57 to sandwich cryocooler flange 15 and clamp slider assembly 70 to cryocooler 10.

The extended length of slider rod 60 is adequate to enable the alignment of the slider rod and its insertion into aperture 54 of guide 52 while cryocooler 10 is positioned above and outside the internal regions of sealed cavity 22. This enables engagement and insertion of the slider rod 60 without significant magnetic field attraction of the magnetic field generated by superconducting magnet coils 34 on cryocooler 22 avoiding the strong force tending to pull cryocooler 10 out of axial alignment in sealed cavity 22. That is, with superconducting magnet 30 at field or superconducting operation, slider rod 60 is slid into tube 58 while cryocooler 10 is in a region of lower magnetic field, after which the tube and slider combination 82 accurately guides the axis of cryocooler 30 along axis 21 while resisting the strong magnetic attraction from the magnetic field generated by superconducting coils 34 as the cryocooler is lowered into sealed cavity 22. This decreases the possibility of misalignment of cryocooler 10 and improper thermal mating of the thermal interfaces by ensuring fully parallel and centered mating surfaces of thermal members such as 47 and 49 of thermal interface or joint 50. Guide assembly 52 and rod 60 of slider assembly 70 also minimize the force and weight which a field engineer must overcome and handle in installing cryocooler 10 into sealed cavity 22, decreasing the chance of an injury to, and contributing to the safety of the installer or field engineer.

A pair of diametrically opposed guide and slider combinations 82 (see FIGS. 1 and 4) may be utilized, and slider rod 60, aperture 54 and tube 58 could be of circular or other cross-section.

Threaded retaining bolt 80 (see FIGS. 3 and 4) passes through threaded member 83 and guide tube 58 to contact slider rod 60 to retain the rod and attached cryocooler 10 in position after the cryocooler in inserted and proper thermal contact is obtained at thermal interfaces such as 50. The operation of this fastener may be facilitated by utilizing knurling 81 for bolt 80.

While only certain features of the invention have been illustrated and described herein many modifications and changes will occur to those skilled in the art. It is, therefore, to be understood that the appended claims are intended to cover all such modifications and changes as fall within the true spirit of the invention.

What is claimed is:

1. In a superconducting magnet including an vacuum vessel and a selectively insertable and removable cryocooler within a sealed cavity enabling the cryocooler to be inserted and removed without breaking the vacuum or discontinuing superconducting operation of the magnet, a positioning assembly comprising:

a guide assembly secured to said superconducting magnet including a guide tube extending parallel to the axis of said cryocooler; and an axially extending slider assembly including a rod secured to said cryocooler for movement therewith and positioned and dimensioned for said rod to fit closely within and slide within said guide as said cryocooler is inserted into said sealed cavity, and to be removed from said superconducting magnet upon removal of said cryocooler from said superconducting magnet;

said guide assembly and extending rod maintaining the axis of said cryocooler along the axis of said sealed cavity in the presence of magnetic forces of a magnetic field generated by said superconducting magnet and acting on said cryocooler;

wherein said guide is a tube including an axial opening dimensioned to closely surround said axial extending rod and said axial extending rod is long enough to enable engagement of said rod with said guide tube before said cryocooler is sufficiently positioned within said sealed cavity to be subjected to said magnetic forces;

whereby said guide assembly assists in resisting said magnetic forces to facilitate the proper positioning and axial alignment of said cryocooler in said superconducting magnet.

2. The cryocooler positioning assembly of claim 1 wherein the clearance between said guide and said axial extending rod is less than 0.2 inches.

3. The cryocooler positioning assembly of claim 1 wherein there are a plurality of combination guide and slider assemblies positioned around said cryocooler each of which include a cooperating guide tube and axially extending rod.

4. The cryocooler positioning assembly of claim 3 wherein said guide tube and said axially extending rod are circular in cross-section.

5. In a superconducting magnet including an vacuum vessel and a selectively insertable and removable cryocooler within a sealed cavity enabling the cryocooler to be inserted and removed without breaking the vacuum or discontinuing superconducting operation of the magnet, a positioning assembly comprising:

a guide assembly secured to said superconducting magnet including a guide tube extending parallel to the axis of said cryocooler;

an axially extending slider assembly including a rod secured to said cryocooler and positioned and dimensioned for said rod to slide within said guide as said cryocooler is inserted into said sealed cavity;

said guide assembly and extending rod maintaining the axis of said cryocooler along the axis of said sealed cavity in the presence of magnetic forces between a magnetic field generated by said superconducting magnet and said cryocooler;

said guide assembly is a tube including an axial opening dimensioned to surround said axial extending rod and said axial extending rod is long enough to enable engagement of said rod with said guide tube before said cryocooler is positioned within said sealed cavity; and said axial opening and said axial extending rod are rectangular in cross-section.

6. The cryocooler positioning assembly of claim 5 wherein there are a pair of diametrically opposed guide and axially extending combination.

7. The cryocooler positioning assembly of claim 5 wherein a locking mechanism on said guide assembly contacts said rod to secure said cryocooler in said sealed cavity of said superconducting magnet.

8. The cryocooler positioning assembly of claim 7 wherein said locking mechanism includes a rotatable threaded member cooperating with internal threads in said guide tube of said guide assembly.

9. The cryocooler positioning assembly of claim 8 wherein said sealed cavity includes a flange at the outer end thereof, said guide assembly is secured to said flange, and said positioning assembly enables the alignment of said cryocooler in said sealed cavity during insertion of said cryocooler into said sealed cavity with continued operation of said superconducting magnet notwithstanding said magnetic forces acting to force said cryocooler out of alignment.

10. The cryocooler positioning assembly of claim 9 wherein said cryocooler includes a warm end flange and said slider assembly is secured to said cryocooler with bolts extending through a mounting member including a pair of parallel members which sandwich said warm end flange.

11. A cryocooler positioning assembly to guide and position a cryocooler in a sealed cavity within the evacuated vessel of a superconducting magnet comprising:

a pair of cooperating assemblies including an axially extending slider assembly; and a guide assembly including an axial extending opening dimensioned to receive and guide said slider;

one of said cooperating assemblies being secured to said cryocooler for movement therewith and the other said cooperating assemblies being secured to said evacuated vessel adjacent said sealed cavity;

said guide and said slider assemblies positioned to enable the selective axial insertion of said cryocooler into said sealed cavity while guiding said cryocooler to maintain the axial alignment of said cryocooler in said sealed cavity notwithstanding magnetic forces from the magnetic field of said superconducting magnet which act to force said cryocooler out of alignment;

one of said cooperating assemblies includes an axially extending rod; and the other of said cooperating assemblies includes an axial tubular opening dimensioned to closely surround said axially extending rod;

said assemblies engaging each other prior to a significant portion of said cryocooler being positioned in said cavity and subjected to said magnetic forces; and said assemblies cooperating to facilitate the insertion of said cryocooler into said sealed cavity during operation of said superconducting magnet;

whereby said positioning assembly assists in resisting said magnetic forces to maintain said axial alignment within said cavity and thermal contact between said cryoocooler and said superconducting magnet.

12. The cryocooler guide assembly of claim 11 wherein one of said assemblies is secured to said cryocooler and extends parallel to the axis of said cryocooler a substantial distance adequate to enable engagement of said slider and guide assemblies before said significant portion of said cryocooler is positioned within said cavity.

13. The cryocooler guide assembly of claim 12 wherein said cryocooler includes a warm end flange remote from the interior of said superconducting magnet, and said slider assembly is secured to said flange.

14. The cryocooler guide assembly of claim 13 wherein said guide assembly is welded to the outside of said sealed cavity and said slider assembly is bolted to said cryocooler warm end flange.

15. The cryocooler guide assembly of claim 12 wherein there are a plurality of said slider assembly and said assembly guide combinations surrounding said sealed cavity.

16. The cryocooler guide assembly of claim 12 wherein the positioning of said cryocooler further includes a selective locking mechanism including a rotatable threaded member extending through cooperating threads in said guide assembly to contact said slide assembly to secure said cryocooler positioned in said sealed cavity.

17. The cryocooler guide assembly of claim 15 wherein said slider assembly includes a pair of parallel plates which are positioned on opposite sides of said warm end flange and bolts extend through said plates to secure said slider to said warm end flange.

* * * * *